United States Patent [19]

Otobe et al.

[11] Patent Number: 4,633,093

[45] Date of Patent: Dec. 30, 1986

[54] METHOD OF FEEDBACK-CONTROLLING IDLING SPEED OF INTERNAL COMBUSTION ENGINE

[75] Inventors: Yutaka Otobe, Shiki; Takahiro Iwata, Asaka, both of Japan

[73] Assignee: Honda Giken Kogyo Kabushiki Kaisha, Tokyo, Japan

[21] Appl. No.: 692,265

[22] Filed: Jan. 17, 1985

[30] Foreign Application Priority Data

Jan. 18, 1984 [JP] Japan ..... 59-6772

[51] Int. Cl.[4] ..... F11D 15/10; F02D 9/02

[52] U.S. Cl. ..... 290/40 R; 290/40 A; 290/40 B; 290/40 C; 290/40 D; 123/339

[58] Field of Search ..... 290/40 A, 40 B, 40 C, 290/40 D, 40 E, 40 R; 60/39.281; 123/339, 492, 493, 493; 364/431.03, 431.05, 431.07

[56] References Cited

U.S. PATENT DOCUMENTS

| | | | |
|---|---|---|---|
| 4,406,262 | 9/1983 | Ikeura | 123/339 |
| 4,529,887 | 7/1985 | Johnson | 290/40 A |
| 4,553,516 | 11/1985 | Hasegawa | 123/339 |
| 4,562,808 | 1/1986 | Tominaga et al. | 290/40 R X |
| 4,570,592 | 2/1986 | Otobe | 123/339 |
| 4,572,141 | 2/1986 | Hasegawa et al. | 123/339 |

*Primary Examiner*—William M. Shoop, Jr.
*Assistant Examiner*—Sharon D. Logan
*Attorney, Agent, or Firm*—Armstrong, Nikaido, Marmelstein & Kubovcik

[57] ABSTRACT

An idling speed feedback control method for use with an internal combustion engine having electrical load equipment and a generator for supplying electric power to the electrical load equipment, the generator being driving by the engine. The idling speed feedback control amount is effected as a function of the difference between an actual engine speed and a target idling speed. The method comprises the steps of detecting a generating state signal as a function of the field coil current of the generator which represents the generating state of the generator; detecting the actual engine speed; determining an electrical load correction value during a time period starting at or before the time when the electrical load correction value changes and ending at the time at or after the electrical load correction value changes. The electrical load correction value is then modified in accordance with the magnitude of the change and the idling speed feedback control is corrected as a function of the modified electrical load correction value.

4 Claims, 5 Drawing Figures

METHOD OF FEEDBACK-CONTROLLING IDLING SPEED OF INTERNAL COMBUSTION ENGINE

BACKGROUND OF THE INVENTION

1. Field of the Invention

The present invention relates to a method of feedback-controlling the idling speed of an internal combustion engine and, more particularly, to an idling speed feedback control method wherein the magnitude of the electrical load on the engine, when electrical load equipment or devices are in an operative state is accurately detected, and supplementary air is applied in accordance with the magnitude of electrical load, to thereby eliminate any speed control delay.

2. Description of the Prior Art

An idling speed feedback control method is known in which a target idling speed is set in accordance with the load conditions of an engine, and the difference between the target idling speed and the actual engine speed is detected. The engine is then supplied with an amount of auxiliary air which corresponds to the magnitude of the detected difference so that the difference becomes zero, thereby controlling the engine speed so that it is maintained at the target idling speed, e.g., Japanese Patent Laid-Open No. 98,628/80.

In the above-described method, if an electrical load device, such as a headlight or an electrically-operated radiator cooling fan motor, is actuated during idling speed feedback control (referred to as "feedback mode control", hereinafter), an alternating current (AC) generator which supplies electric power to the actuated electrical load is actuated. As a result, the operation of the AC generator increases the engine load, resulting in a lowering of the engine speed. The lowered engine speed is shortly returned to the target idling speed by virtue of the feedback mode control. However, when a large electrical load is applied to the engine, the engine may be stalled, or it may become impossible to smoothly engage the clutch when the vehicle is started simultaneously with increasing of the electrical load.

In view of the above, an engine speed control method has been proposed by the applicant of the present invention in Japanese Application Laid-Open No. 197,449/83, in which the ON-OFF state of each of a plurality of electrical load devices is detected, and at the same time, as the ON state of each electrical load device is detected, the valve-opening duration of a control valve which controls the auxiliary air amount is increased by a predetermined period of time in accordance with the magnitude of the electrical load, whereby the delay in the auxiliary air amount control is minimized, thereby improving driveability.

Presently, however, internal combustion engines are equipped with a great variety of equipment which are electrical loads in order to improve the operation performance of the engines and further to ensure safe traveling of vehicles equipped with such engines. For this reason, it is necessary to provide a number of sensors and input ports corresponding to the number of the electrical load devices in order to detect the ON-OFF state of each of the electrical load devices. Further, it is necessary to store a predetermined valve-opening duration for the auxiliary air control valve associated with each electrical load device. In consequence, there is a need for a more complicated control program, which results in an increase in the memory capacity of the controller. As a result, the cost of the controller is significantly increased. In order to avoid these disadvantages, a method may be adopted in which, only some of the electrical equipment, for example, some of the which apply a heavy load to the engine are monitored for the purpose of control, and the electrical load correction of the auxiliary air amount is effected only when one of the monitored electrical devices is turned ON or OFF. In this method, however, when one or a plurality of the electrical load devices which are not monitored are turned ON or OFF simultaneously with a monitored electrical load device, because of the feedback mode control delay, the engine speed is temporarily lowered or raised, which makes it difficult to maintain the engine speed at or in the vicinity of the target idling speed.

SUMMARY OF THE INVENTION

The present invention aims at overcoming the above-described problems and provides an idling speed feedback control method wherein, during the idling operation of an internal combustion engine which has electrical load equipment and a generator supplying electric power to the electrical load equipment and which drives the generator, feedback control is effected on the basis of a control signal which is determined in accordance with the difference between actual engine speed and a target idling speed. The method of feedback-controlling the idling speed of the internal combustion engine comprises the steps of: detecting a generating state signal value representing the generating state of the generator; detecting an actual engine speed signal; determining an electrical load correction value in accordance with the detected generating state signal value and the detected actual engine speed signal; and correcting the control amount during the idling operation in accordance with the determined electrical load correction value. The magnitude of all the electrical loads in an operative state is accurately detected from the generating state of the generator which supplies electric power to the electric load devices, thereby eliminating any idle speed feedback control delay of the internal combustion engine.

DETAILED DESCRIPTION OF THE PREFERRED EMBODIMENT

Figure 1:
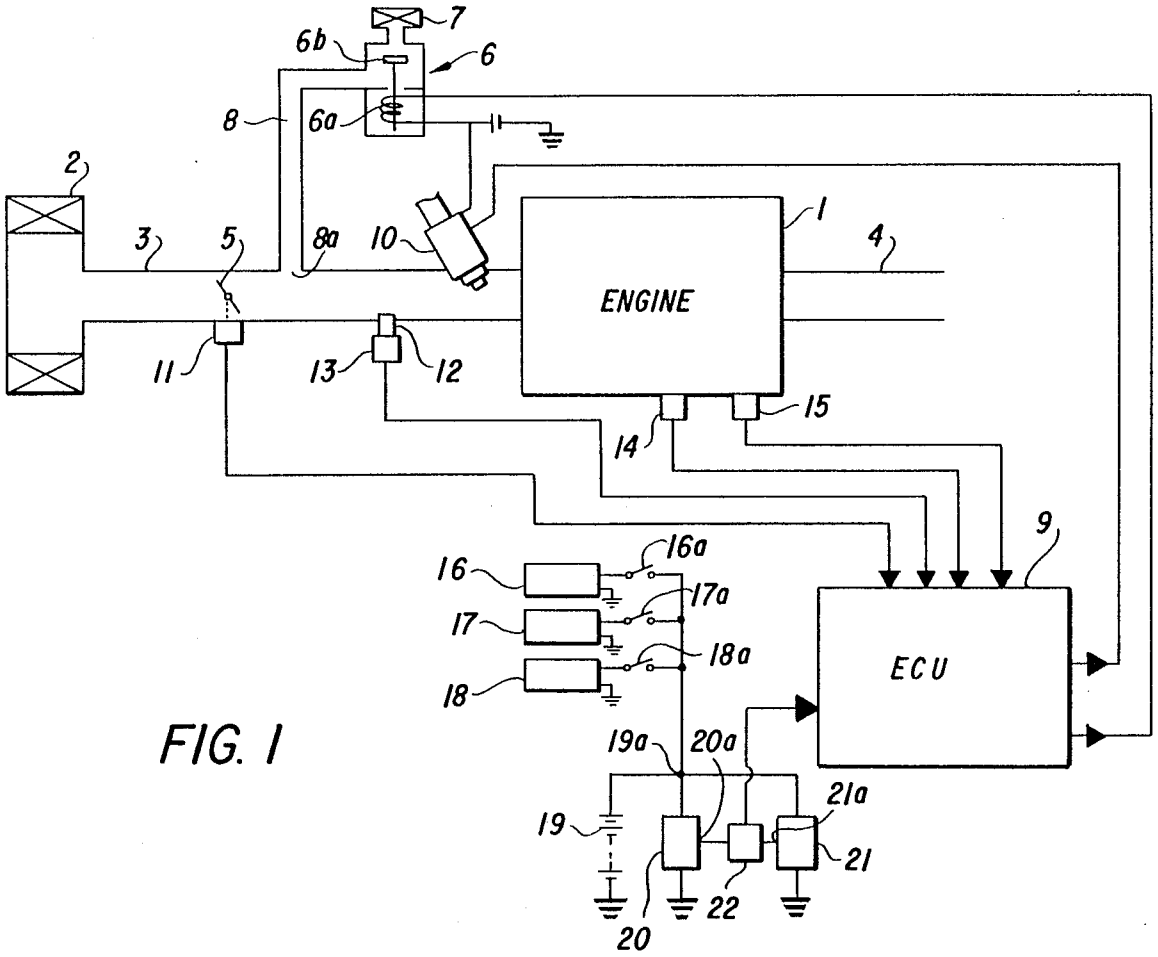
FIG. 1 is a schematic diagram showing an engine speed controller for an internal combustion engine which uses the idling speed feedback control method in accordance with the present invention.

FIG. 1 schematically shows an engine speed controller for an internal combustion engine to which the method of the present invention is applied. A four-cylinder internal combustion engine 1 is connected to an intake pipe 3 having an air cleaner 2 mounted at its forward end and an exhaust pipe 4 connected to its rear end. A throttle valve 5 is disposed in the intake pipe 3. Further, an air passage 8 is provided which has one end 8a opening into a portion of the intake pipe 3 on the downstream side of the throttle valve 5 and the other end communicating with the atmosphere through an air cleaner 7. An auxiliary air amount control valve 6 (referred to simply as a "control valve", hereinafter) is disposed in an intermediate portion of the air passage 8. The control valve 6 controls the amount of auxiliary air to be supplied to the engine 1. The control valve 6 comprises a normally-closed type electromagnetic valve which has a solenoid 6a and a valve 6b which opens the air passage 8 when the solenoid 6a is energized. The solenoid 6a is electrically connected to an electronic control unit 9 (referred to as an "ECU", hereinafter).

A fuel injection valve 10 projects into the intake pipe 3 at a location between the engine 1 and the opening 8a of the air passage 8. The fuel injection valve 10 is connected to a fuel pump, not shown, and also is electrically connected to the ECU 9.

A throttle valve opening sensor 11 is attached to the throttle valve 5. An intake manifold absolute pressure sensor 13 which communicates with the intake pipe 3 through a pipe 12 is provided in the intake pipe 3 on the downstream side of the opening 8a of the air passage 8. Further, an engine coolant temperature sensor 14 and an engine rpm sensor 15 are attached to the body of the engine 1. These sensors are electrically connected to the ECU 9. First, second and third electrical load devices, 16, 17 and 18 respectively, such as a headlight, a radiator cooling fan motor and a heater blower motor, have one of the terminals thereof connected to a node 19a through each of the switches 16a, 17a and 18a. The other terminal of the devices is grounded. A battery 19, an alternating current (AC) generator 20, and a voltage regulator 21 which supplies field coil current to the generator 20 are connected in parallel between node 19a and ground and supply power to load equipment 16, 17 and 18. A field coil current output terminal 21a of the voltage regulator 21 is connected to a field coil current input terminal 20a of the generator 20 through a generating state detector 22. The generating state detector 22 supplies the ECU 9 with a signal representing the generating state of the generator 20, for example, a signal E having a voltage level corresponding to the magnitude of the field coil current supplied from the voltage regulator 21 to the generator 20.

The generator 20 is mechanically connected to an output shaft (not shown) of the engine 1 and is driven by the engine 1. When the switches 16a, 17a, 18a are closed (ON), electric power is supplied to the electrical load equipment 16, 17 and 18 from the generator 20. When the electric power required for operating the electrical load equipment 16, 17 and 18 exceeds the generating capacity of the generator 20, a shortage of the electric power is complemented by the battery 19.

Various engine operation parameter signals are supplied to the ECU 9 from the throttle valve opening sensor 11, the intake manifold absolute pressure sensor 13, the coolant temperature sensor 14 and the engine rpm sensor 15, together with the generating state signal from the generating state detector 22. On the basis of these engine operation condition parameter signals and the generating state signal, the ECU 9 determines engine operating conditions and engine load conditions, such as electrical load conditions, and sets a target idling speed during an idling operation in accordance with these determined conditions. The ECU 9 further calculates the amount of fuel to be supplied to the engine 1, that is, a valve-opening duration for the fuel injection valve 10, and also the amount of auxiliary air to be supplied to the engine 1, that is, a valve-opening duty ratio of the control valve 6. The ECU supplies the respective driving signals to the fuel injection valve 10 and the control valve 6 in accordance with the respective calculated values.

The solenoid 6a of the control valve 6 is energized over a valve-opening duration corresponding to the calculated valve-opening duty ratio, to open the valve 6b thereby opening the air passage 8, whereby a necessary amount of auxiliary air corresponding to the calculated valve-opening duration is supplied to the engine 1 through the air passage 8 and the intake pipe 3.

The fuel injection valve 10 is opened over a valve-opening duration corresponding to the above-described calculated value to inject fuel into the intake pipe 3. The ECU 9 operates to supply an air/fuel mixture having a desired air/fuel ratio, e.g. a stoichimetric air/fuel ratio, to the engine 1.

When the valve-opening duration of the control valve 6 is increased to increase the amount of auxiliary air, the increased amount of the air-fuel mixture is supplied to the engine 1 to thereby increase the engine output resulting in a rise in the engine speed. Conversely, when the valve-opening duration of the control valve 6 is decreased, the amount of a air/fuel mixture supplied is decreased, resulting in a decrease in the engine speed. Thus, it is possible to control the engine speed by controlling the amount of auxiliary air, that is, the valve-opening duration of the control valve 6.

Figure 2:
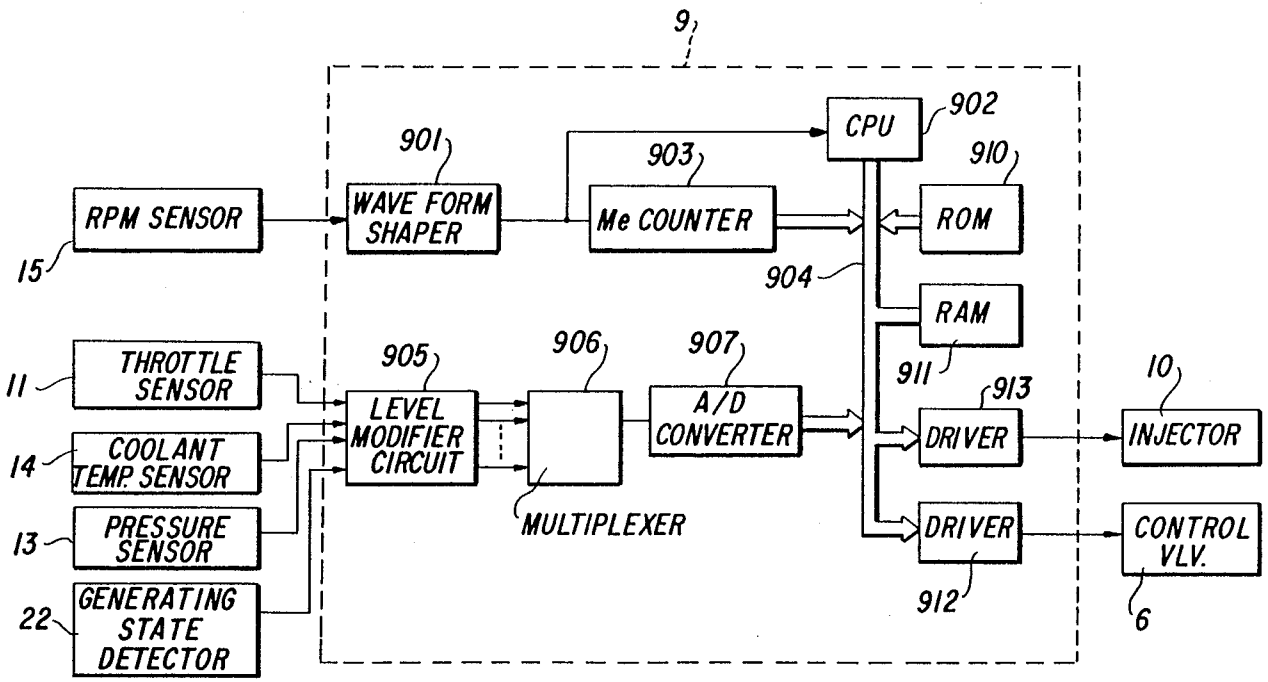
FIG. 2 is a circuit diagram showing the electronic control unit (ECU) shown in FIG. 1.

FIG. 2 shows a circuit diagram of the ECU 9 shown in FIG. 1. An output signal from the engine rpm sensor 15 is applied to a waveform shaping circuit 901 and is then supplied to a central processing unit (CPU) 902 and also to an $M_e$ counter 903 as a TDC signal representing a predetermined angle of the crank angle, for example, the top dead center. The $M_e$ counter 903 counts the interval of time from the preceding pulse of a TDC signal to the present pulse of a TDC signal, and therefore the count $M_e$ is inversely proportional to the engine speed $N_e$. The $M_e$ counter 903 supplies the counted value $M_e$ to the CPU 902 via a data bus 904.

Output signals from various sensors, such as the throttle valve opening sensor 11, the intake manifold pressure sensor 13 and the engine coolant temperature sensor 14, which are shown in FIG. 1, together with a signal from the generating state detector 22, are modified to a predetermined voltage level in a level shifter unit 905 and are then successively applied to an A/D converter 907 by means of a multiplexer 906. The A/D converter 907 successively converts the signals from the sensors 11, 13, 14 and the detector 22 into digital signals and supplies the digital signals to the CPU 902 via the data bus 904.

The CPU 902 is further connected via the data bus 904 to a read only memory (ROM) 910, a random-access memory (RAM) 911 and driving circuits 912, 913. The RAM 911 temporarily stores, for example, the results of the calculation carried out in the CPU 902 and various sensor outputs. The ROM 910 stores a control program executed in the CPU 902 and a valve-opening duty ratio $D_{EX}$ table as a reference correction value, described later.

The CPU 902 executes the control program stored in the ROM 910, evaluates engine operating conditions and engine load conditions on the basis of the above-described various engine parameters and generating state signal, and calculates a valve-opening duty ratio $D_{OUT}$ for the control valve 6 which controls the amount of auxiliary air. The CPU 902 then supplies the driving circuit 912 with a control signal corresponding to the calculated value.

The CPU 902 further calculates a fuel injection duration $T_{OUT}$ for the fuel injection valve 10 and supplies a control signal based on the calculated value to the driving circuit 913 via the data bus 904. The driving circuit 913 supplies the fuel injection valve 10 with a control signal, which opens the fuel injection valve 10, in accordance with the calculated value. The driving circuit 912 supplies the control valve 6 with an ON-OFF driving signal which controls the control valve 6.

Figure 3:
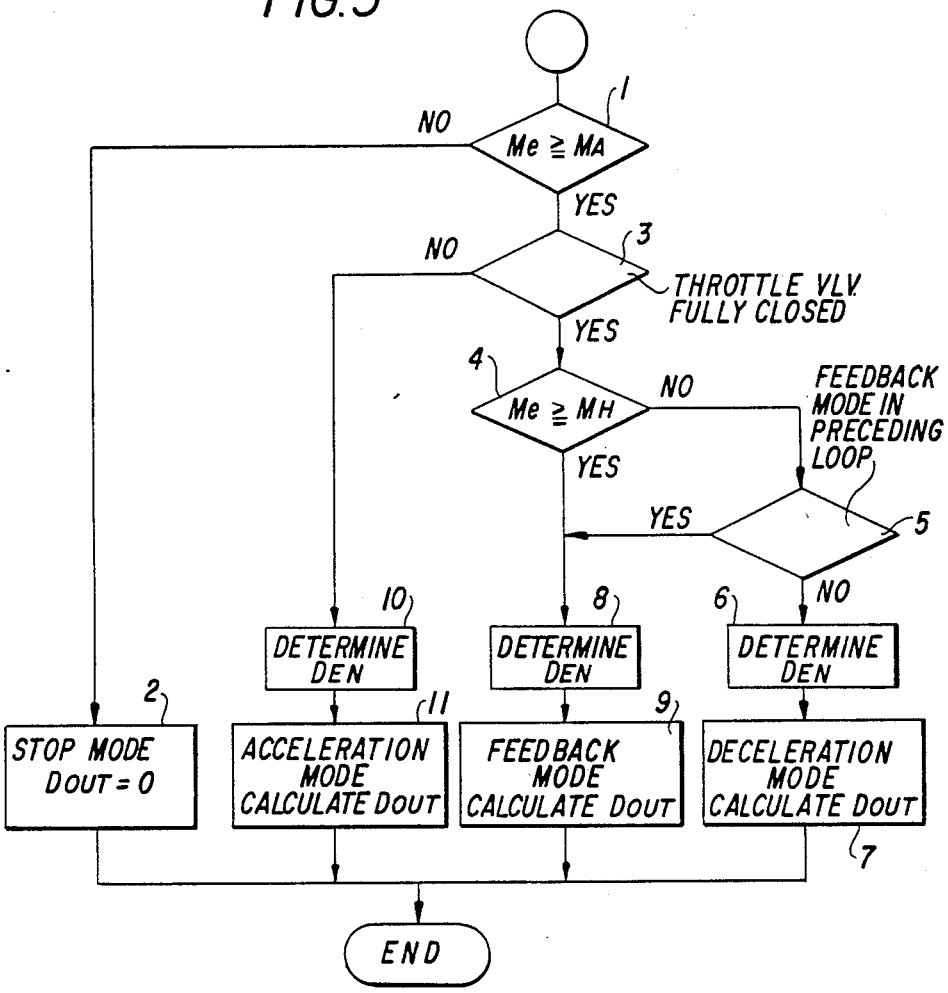
FIG. 3 is a program flow chart showing the procedure for calculation, in the ECU, of a valve-opening duty ratio $D_{OUT}$ of a control valve.

FIG. 3 is a program flow chart showing the calculation of the valve-opening duty ratio $D_{OUT}$ of the control valve 6 which is executed in the CPU 902 each time a TDC signal pulse is generated.

The counting is effected by the $M_e$ counter 903 in the ECU 9, and a decision is made as to whether or not a value $M_e$ which is proportional to the reciprocal of the engine speed $N_e$ is larger than a value $M_A$ corresponding to the reciprocal of a predetermined engine speed $N_A$ (e.g., 1,500 rpm) (step 1). If the result of the decision in step 1 is negative (No) ($M_e \geqq M_A$ is not valid), that is, if the engine speed $N_e$ is higher than the predetermined value $N_A$, the supply of auxiliary air is not required, and consequently, the valve-opening duty ratio $D_{OUT}$ of the control valve 6 is set at zero in step 2, (the control mode in which the valve-opening duty ratio $D_{OUT}$ is set at zero so that the control valve 6 is totally closed will be referred to as a "stop mode", hereinafter).

If the result of the decision in step 1 is affirmative (Yes) ($M_e \geqq M_A$ is valid), that is, if the engine speed $N_e$ is lower than the predetermined value $N_A$, a decision is made as to whether or not the throttle valve 5 is substantially fully closed in step 3. If the throttle valve 5 is substantially fully closed, then, a decision is made as to whether or not $M_e$ is larger than a value $M_H$ corresponding to the reciprocal of a predetermined higher-limit value $N_H$ of the target idling speed in step 4. If the result of the decision is negative (No), that is, if the engine speed $N_e$ is higher than the predetermined higher-limit value $N_H$ of the target idling speed, and if the preceding control loop was not effected by a feedback mode as described later (the result of a decision in a step 5 is negative (No)), an electrical load term $D_{En}$ corresponding to the engine speed $N_e$ and the value of a generating state signal from the generating state detector 22 shown in FIG. 1 is calculated in step 6, as described later in detail. Then, the process proceeds to step 7, in which the valve-opening duty ratio $D_{OUT}$ in the control of a deceleration mode is calculated.

The duty ratio $D_{OUT}$ for deceleration mode control is set, for instance, to a value which is the sum of a deceleration mode term Dx and an electrical load term $D_{En}$ calculated in the step 6. The deceleration mode term Dx may be set at a predetermined value corresponding to the values of engine operating condition parameter signals, such as a signal from the engine coolant temperature sensor, for maintaining the engine speed $N_e$ at desired idling rpm. The engine has previously been supplied with an amount of auxiliary air set by the deceleration mode over the period from when the engine speed $N_e$ becomes lower than the predetermined speed $N_A$ to the time when the engine speed $N_e$ reaches the higher-limit value $N_H$ of the target idling speed and the control by the feedback mode, described later, is commenced. It is thus possible to smoothly shift to the control of the feedback mode control without any possibility of the engine speed overshooting below the target idling speed.

If the engine speed $N_e$ is lowered such that the result of the decision in the step 4 is affirmative (Yes) ($M_e \leqq M_H$ is valid), that is, if the engine speed $N_e$ becomes lower than the predetermined higher-limit value $N_H$ of the target idling speed, calculation of the electrical load term $D_{En}$ is carried out as described later (step 8), and then, calculation of the valve-opening duty ratio $D_{OUT}$ in the control by the feedback mode is carried out in step 9.

The calculation of the valve-opening duty ratio $D_{OUT}$ by the feedback mode is carried out such that, for example, a value of a valve-opening duty ratio for the present loop is obtained by adding the electrical load term $D_{En}$ calculated in step 8 to a PI control term $D_{PIn}$ calculated in accordance with the difference between the target idling speed and the actual engine speed to make difference zero, that is, to make the engine speed $N_e$ equal to the predetermined higher and lower limit values $N_H$ and $N_L$ of the target idling speed.

During the control of the idling speed by the feedback mode, when the engine load is lightened due to a changing or cutting off of electrical loads such that the engine speed $N_e$ exceeds the higher-limit value $N_H$ of the target idling speed, when the control by the deceleration mode has been terminated and the control of the feedback mode is commenced, the auxiliary air amount control by the feedback mode is continued even if the engine speed $N_e$ exceeds the higher-limit value $N_H$, as long as the throttle valve 5 is fully closed. This is because there is no fear of any engine stall and it is possible to effect a speedy and accurate speed control. When the engine speed exceeds the higher-limit value $N_H$ of the target idling speed due to a change or cutting off of electrical loads, the fact that $M_e \geqq M_H$ is not valid is decided in step 4, and the process proceeds to step 5, in which a decision is made as to whether or not the preceding control loop was effected by the feedback mode. If it was the feedback mode (if the result of the decision is affirmative (Yes)), the process proceeds to steps 8 and 9, in which control by the feedback mode is continued.

Next, when the throttle valve 5 is opened during the idling operation by the feedback mode control, an auxiliary air amount control of an acceleration mode is commenced. More specifically, if the result of the decision in step 3 is negative (No), the process proceeds to step 10, in which the electrical load term $D_{En}$, described later, is calculated, and then, in step 11, calculation of the valve-opening duty ratio in the control of the acceleration mode is carried out.

The calculation of the valve-opening duty ratio $D_{OUT}$ in the acceleration mode is carried out as follows: When the throttle valve 5 is opened during the idling operation such that the engine operation is shifted to an acceleration operation, the supply of auxiliary air by the control valve 6 is not abruptly suspended, but the valve-opening duty ratio set in the feedback mode control immediately prior to opening of the throttle valve 5 is used as an initial value $D_{PIn-1}$. Thereafter, the initial value is decreased by a predetermined value $\Delta D_{Acc}$ every time a TDC signal pulse is generated until the initial value becomes zero, and the electrical load term $D_{En}$ calculated in step 10 is added to the thus decreased valve-opening duty ratio value ($D_{PIn-1}-\Delta D_{Acc}$), thereby setting the valve-opening duty ratio $D_{OUT}$ for the present loop. Thus, it is possible to prevent any sudden lowering of the engine speed and to smoothly shift the engine operation to a acceleration operation.

Figure 4:
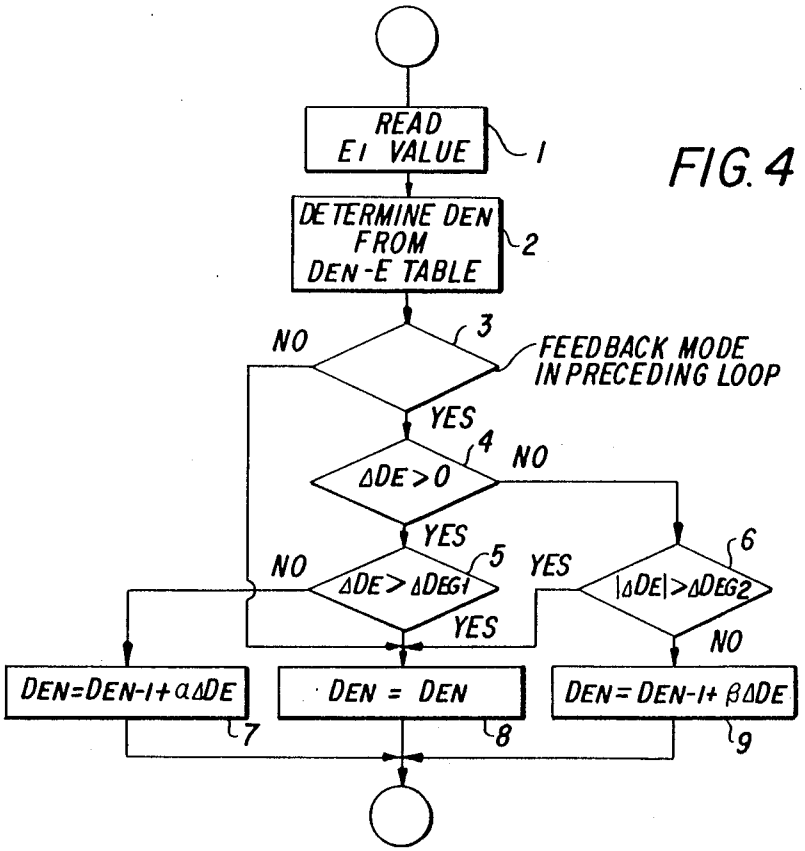
FIG. 4 is a program flow chart showing the procedure for setting an electrical load term value $D_{En}$ of the valve-opening duty ratio $D_{OUT}$ of the control valve, in accordance with the present invention.

FIG. 4 is a flow chart showing the calculation of the electrical load term $D_{En}$ executed in steps 6, 8 and 10 of FIG. 3.

Figure 5:
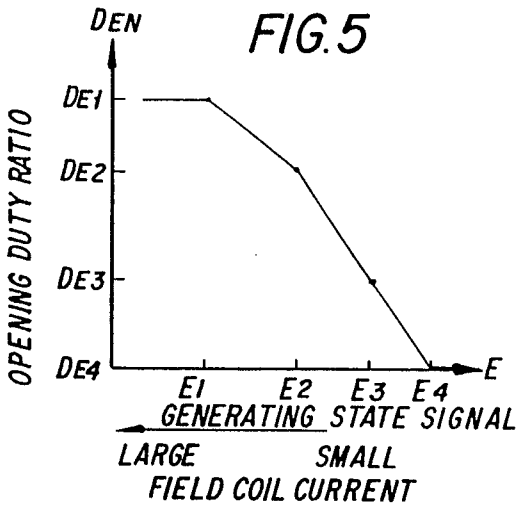
FIG. 5 is a table showing the relationship between a generating state signal value E and a valve-opening duty ratio $D_{EX}$ as a reference correction value.

First of all, the value E of a generating state signal is read out from the generating state detector 22 shown in FIG. 1, the value of E corresponding to the magnitude of the field coil current of the generator 20 (step 1), and E is converted into a digital signal in the A/D converter 907. Next, a $D_{En}$ value is set from a correction coefficient $K_E$ and a table showing the relationship between the valve-opening duty ratio $D_{EX}$ and the generating state signal value E (step 2). More practically, first, a valve-opening duty ratio $D_{EX}$ corresponding to the generating state signal value E is determined from, for example, a table showing the relationship between the valve-opening duty ratio $D_{EX}$ and the generating state signal value E at a reference engine speed (e.g., 700 rpm) such as that shown in FIG. 5. In the table of FIG. 5, generating state signal values are respectively set at $E_1$ (e.g., 1 V), $E_2$ (e.g., 2 V), $E_3$ (e.g., 3 V) and $E_4$ (e.g., 4.5 V), and valve-opening duty ratios as reference correction values corresponding to the set values are respectively set at $D_{E1}$ (e.g., 50%), $D_{E2}$ (e.g., 30%), $D_{E3}$ (e.g., 10%), and $D_{E4}$ (e.g., 0%). When the detected generating state signal value E takes a value between the adjacent set values, the valve-opening duty ratio value $D_{EX}$ is calculated by means of interpolation.

Thus the obtained $D_{EX}$ value at the reference engine speed is applied to the following formula (1), whereby an electrical load term $D_{En}$ corresponding to an engine speed is calculated:

$$D_{En}=K_E\times D_{EX} \quad \ldots (1)$$

The correction coefficient $K_E$ is a value calculated in accordance with the difference between a value $M_{ec}$ corresponding to the reciprocal of the reference engine speed (700 rpm) and a value $M_e$ counted by the $M_e$ counter 903 shown in FIG. 2, according to the following formula (2):

$$K_E=\eta\times(M_{ec}-M_e)+1 \quad \ldots (2)$$

where $\eta$ represents a constant (e.g., $8\times10^{-4}$).

The reason the electrical load term $D_{En}$ is set as a function of the engine speed $N_e$ and the value E of the generating state signal corresponding to the field coil current of the generator is that the magnitude of the loads on the engine when the generator is in an operative state is proportional to the amount of electric power generated by the generator and the amount of generated electric power is a function of the magnitude of the field coil current and the engine speed, that is, the number of revolutions of the rotor of the generator.

Next, the process proceeds to step 3 shown in FIG. 4, in which a decision is made as to whether or not the control valve 6 was controlled by the feedback mode in the preceding loop. If the result of the decision is negative (No), the value of the electrical load term $D_{En}$ obtained in step 2 is used as the $D_{En}$ value for the present loop (step 8; $D_{En}=D_{En}$). This is because application of the electrical load term value $D_{En}$ set in step 2 to the calculation of the valve-opening duty ratio $D_{OUT}$ in an engine deceleration or acceleration operation has a negligible effect on the engine operation performance as described later.

If the result of the decision in step 3 is affirmative (Yes), the degree of change of the electrical load term value $D_{En}$ is decided in subsequent steps 4 to 6. More specifically, in step 4, a decision is made as to whether or not the amount $\Delta D_E$ of change between the electrical load term value $D_{En}$ for the present loop and the electrical load term value $D_{En-1}$ for the preceding loop ($\Delta D_E=D_{En}-D_{En-1}$) is larger than zero. If the change amount $\Delta D_E$ is larger than zero, in step 5, a decision is made as to whether or not the change amount $\Delta D_E$ is larger than a first predetermined value $\Delta D_{EG1}$. On the other hand, if the change amount $\Delta D_E$ is not larger than zero, in step 6, a decision is made as to whether or not the absolute value $|\Delta D_E|$ of the change amount is larger than a second predetermined value $\Delta D_{EG2}$.

If the result of the decision in step 5 or 6 is affirmative (Yes), that is, if the change amount $\Delta D_E$ is larger than the first predetermined value $\Delta D_{EG1}$ in step 5, or if the absolute value $|\Delta D_E|$ of the change amount is larger than the second predetermined value $\Delta D_{EG2}$ in step 6, it means that there has been a change in the ON-OFF state of an electrical load device which imposes a relatively heavy load on the engine. In this case, it is predicted that the engine speed will suddenly increase or decrease. In order to avoid any delay in controlling the auxiliary air amount in response to such a sudden increase or decrease of the engine speed, the process proceeds to step 8, in which the value of the electrical load term $D_{En}$ set in step 2 is used as the $D_{En}$ value for the present loop (step 8).

If the result of the decision in step 5 is negative (No), that is, if the change amount $\Delta D_E$ is positive and smaller than the first predetermined value $\Delta D_{EG1}$, it is predicted that the engine speed will not suddenly change. In such a case, stable speed control can be obtained by gradually increasing the electrical load term value of the valve-opening duty ratio $D_{OUT}$ toward the value $D_{En}$ set for the present loop. For this reason, the process proceeds to step 7, in which an electrical load term value $D_{En}$ for the present loop is obtained through the following formula (3):

$$D_{En}=D_{En-1}+\alpha\Delta D_E \quad \ldots (3)$$

where $\alpha$ represents a modification coefficient, which is set at, for example, the value 0.5 in accordance with dynamic characteristics of the engine. It is to be noted that, if the modification coefficient $\alpha$ is set at the value 1, since $\Delta D_E=D_{En}-D_{En-1}$, the formula (3) is given as follows:

$$D_{En}=D_{En}$$

Thus, the formula (3) is coincident with the formula for calculation in step 8. Further, if $\alpha$ in the formula (3) is given by $\alpha=1-\alpha'$ and is substituted into the formula (3), then, it is also possible to express the formula (3) by the following formula (3)':

$$D_{En}=D_{En}+\alpha'(D_{En-1}-D_{EN})=D_{En}-'\Delta D_E \quad \ldots (3)'$$

In other words, the formula (3)' shows that the electrical load term $D_{En}$ for the preceding loop is set at a value obtained by modifying the $D_{En}$ value obtained in the step 2 by the product value $\alpha'\Delta D_E$ obtained by multiplying the change amount $\Delta D_E$ by the modification coefficient $\alpha'$.

Also, where the result of the decision in the step 6 is negative (No), that is, the change amount $\Delta D_E$ is negative and the absolute value thereof is smaller than the second predetermined value $\Delta D_{EG2}$, it is predicted that the engine speed will not suddenly change. Therefore, in such a case, the process proceeds to step 9, in which the electrical load term value $D_{En}$ for the present loop is obtained through the following formula (4):

$$D_{En}=D_{En-1}+\beta\Delta D_E \quad \ldots (4)$$

where $\beta$ represents a modification coefficient which is set separately from the above-described modification coefficient $\alpha$ and is set at, for example, the value 0.4 in accordance with the dynamic characteristics of the engine. It is also able to express formula (4) by the following formula (4)' as same as formula (3).

$$D_{En}=D_{En}-\beta'\Delta D_E \quad \ldots (4)'$$

where $\beta'$ is given by $\beta'=1-\beta$.

It is to be noted that, although, in the above-described embodiment, the electrical load term $D_{En}$ is obtained in step 2 of FIG. 4 on the basis of the table showing the relationship between the valve-opening duty ratio $D_{EX}$ and the generating state signal value E and the formulas (1) and (2), this setting method is not exclusive. For example, a setting method may be employed in which a plurality of electrical load term map values $D_{En}$ corresponding to the generating state signal value E and the engine speed $N_e$ are previously stored in the ROM 910 and are read out in accordance with a detected generating state signal value E and an actual engine speed value $N_e$.

As has been described above in detail, according to the internal combustion engine idling speed feedback control method of the present invention, the value of a signal representing the generating state of the generator is detected; an actual engine speed is detected; an electrical load correction value is determined which corresponds to the detected generating state signal value and the detected actual engine speed value; and the intake air amount during an idling operation is corrected by the determined electrical load correction value. Accordingly, it is possible to accurately detect engine load variations with a change in the ON-OFF state of each of the electrical load devices. Thus, it is possible to improve the speed control delay.

It is readily apparent that the above-described method of feedback-controlling idling speed of internal combustion engine meets all of the objects mentioned above and also has the advantage of wide commercial utility.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

I claim:

1. An idling speed feedback control method for use with an internal combustion engine having electrical load equipment and a generator for supplying electric power to said electrical load equipment, said generator being driven by said engine, wherein an idling speed feedback control amount is effected as a function of the difference between an actual engine speed and a target idling speed, said method comprising the steps of detecting a generating state signal representing the generating state of said generator; determining an electrical load correction value as a function of the detected generating state signal; determining the amount of charge of the electrical load correction value during a time period starting at or before the time when the electrical load correction value changes and ending at the time at or after the electrical load correction value changes; modifying said electrical load correction value in accordance with the magnitude of the amount of the change; and correcting the idling speed feedback control amount as a function of the modified electrical load correction value.

2. A method of idling speed feedback control as set forth in claim 1 including setting a modification coefficient as a function of the magnitude of the change of the electrical load correction value, wherein modifying said electrical load correction value comprises multiplying the change amount by the modification coefficient.

3. A method of idling speed feedback control as set forth in claim 2, wherein the modification coefficient decreases as the absolute value of the change amount increases.

4. A method of idling speed feedback control as set forth in any one of claims 1 through 3 wherein detecting the generating state signal comprises detecting the field coil current in said generator.

* * * * *